United States Patent [19]

Bergeron

[11] 3,964,790

[45] June 22, 1976

[54] BALL FURNITURE

[76] Inventor: Gaetan G. Bergeron, Box 1324, Assiniboia, Saskatchewan, Canada, S0H 0B0

[22] Filed: Feb. 24, 1975

[21] Appl. No.: 552,054

[30] Foreign Application Priority Data

Feb. 11, 1975 Canada ..... 219796

[52] U.S. Cl. ..... 297/445; 297/118; 297/239; 297/454

[51] Int. Cl.[2] ..... A47C 1/12

[58] Field of Search ..... 35/46 R, 46 A; 297/118, 297/440, 443, 445, 454–456

[56] References Cited

UNITED STATES PATENTS

| | | | |
|---|---|---|---|
| 3,469,882 | 9/1969 | Larsen | 297/118 |
| 3,511,503 | 5/1970 | Volpe | 297/118 X |
| 3,655,242 | 4/1972 | Ghyczy | 297/445 |

FOREIGN PATENTS OR APPLICATIONS

| | | | |
|---|---|---|---|
| 1,654,298 | 2/1971 | Germany | 297/456 |

*Primary Examiner*—James C. Mitchell
*Attorney, Agent, or Firm*—Stanley E. Johnson

[57] ABSTRACT

Pieces of furniture are assembled from segments of a closed hollow shell formed by severing the hollow shell along at least two planes and providing segments of different sizes. The hollow shell from which the segments are formed may be of various different sizes and/or shapes and in each case a minor segment of the hollow shell is provided and includes a lower planar edge for resting flatwise on a floor surface and an upper continuous peripheral edge spaced from such floor surface. A main body for the furniture is provided by a major segment of the hollow shell and has a curvilinear outer surface which seats freely on and in contact with the upper peripheral edge of the base. The main body of the piece of furniture accordingly may be rotated and/or readily tilted.

5 Claims, 23 Drawing Figures

BALL FURNITURE

This invention relates to furniture and more particularly pieces of furniture formed from segments of a closed hollow shell, to pieces of furniture so formed and of different sizes which may be stored in inter-nested relation and to a method of providing segments suitable for use as pieces of furniture.

In U.S. Pat. No. 3,469,882, issued Sept. 30, 1969 to one J. P. Larson, there is disclosed a piece of furniture consisting of a number of cushions hingedly interconnected and when folded together form a cylinder minimizing the area occupied for storage purposes. In an unfolded state there is provided a chair having a seat and back portion or a seat and back portion with a foot rest portion all of which are interconnected spreading out thereby occupying considerable floor space when used as a piece of furniture.

A principal object of the present invention is to provide a piece of furniture which occupies little floor space when collapsed for storage purposes and also when assembled in an in-use position.

A further object of the invention is to provide components which may be stacked in inter-nested relation for storage purposes and which may be readily assembled into multi pieces of furniture for use.

A further object of the invention is to provide pieces of furniture of different sizes and various shapes which may be readily assembled and when disassembled inter-nest one within the other for storage purposes.

Accordingly in accordance with one aspect of the present invention there is provided a piece of furniture formed from a closed hollow shell of selected shape having a curvilinear outer surface comprising:

a. a base consisting of a minor segment of the hollow shell and having a lower planar edge for resting flatwise on a floor surface and an upper continuous peripheral edge spaced from such floor surface and b. a main body consisting of a major segment of said hollow shell and having the curvilinear outer surface thereof seated freely on and in contact with the upper peripheral edge of the base.

In accordance with a further aspect of the present invention there is provided a method of forming furniture comprising a. providing a rigid closed hollow shell of selected shape having a curvilinear outer surface and b. severing said shell along at least two planes to provide complete segments of different sizes.

The invention is illustrated by way of example with reference to the accompanying drawings wherein.

Figure 11:
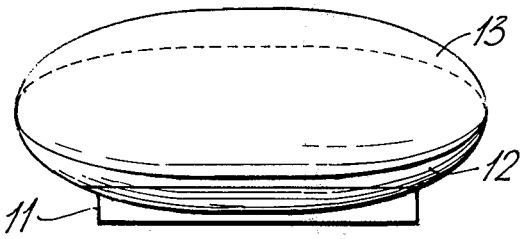
FIGS. 11 to 23 illustrate various shapes of shells from which furniture may be made in accordance with the present invention.
Figure 12:
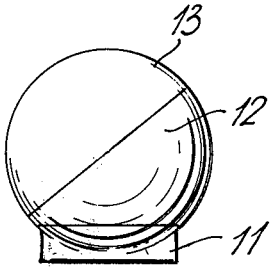
Figure 13:
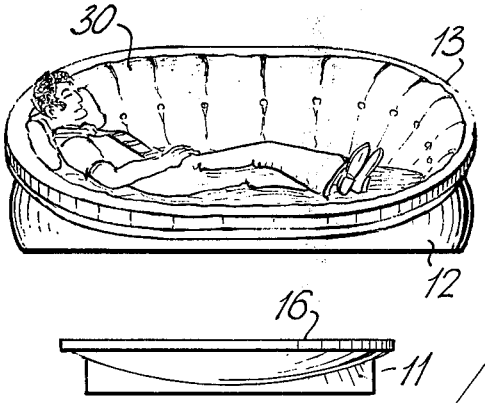
Figure 14:
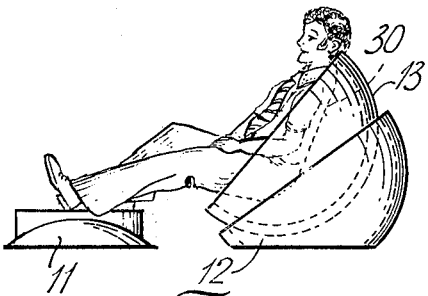
Figure 17:
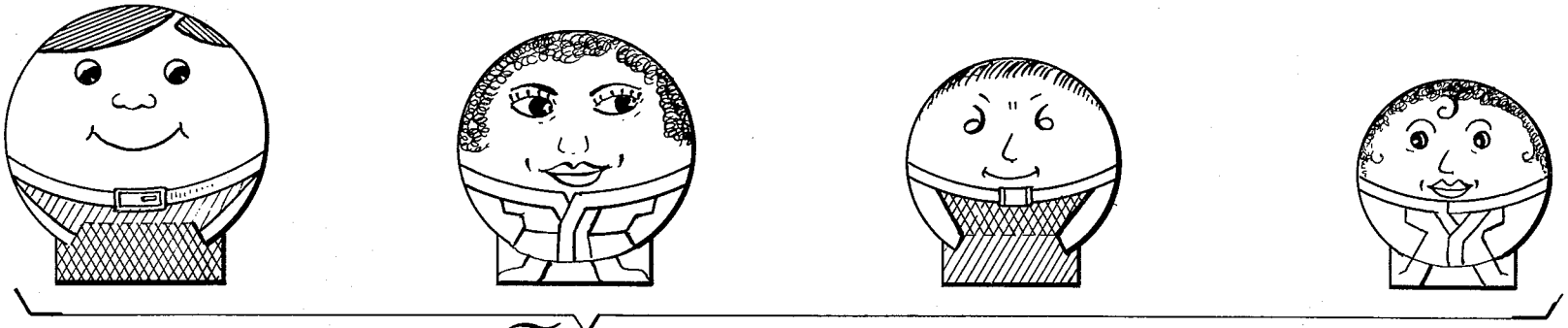
Figure 18:
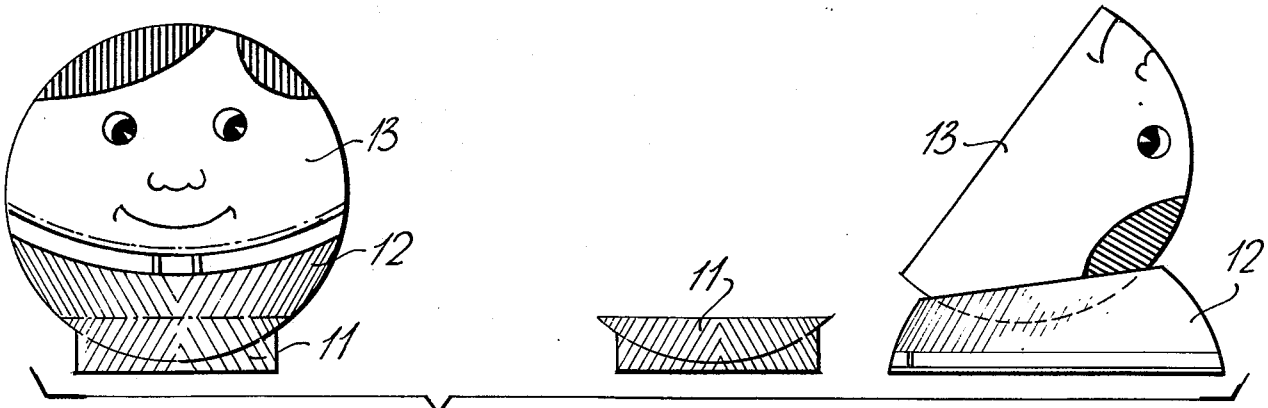
Figure 19:
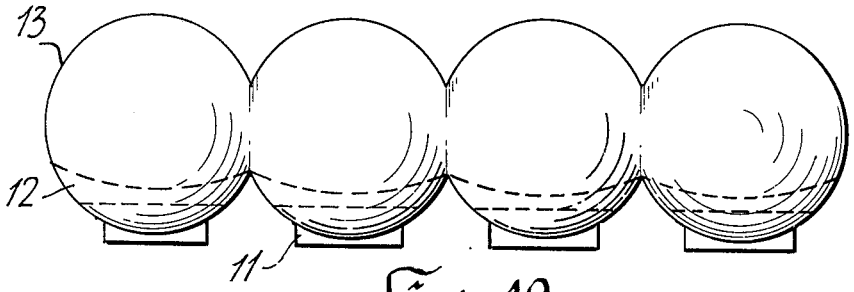
Figure 20:
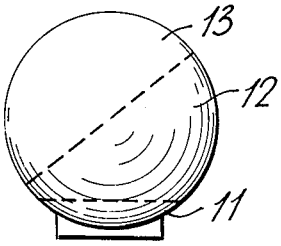
Figure 21:
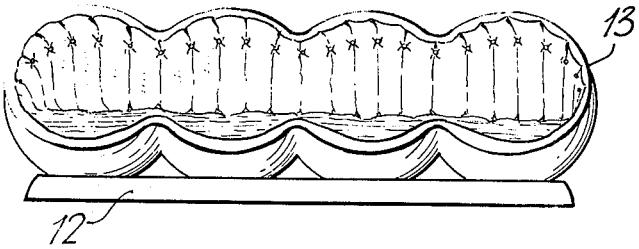
Figure 22:
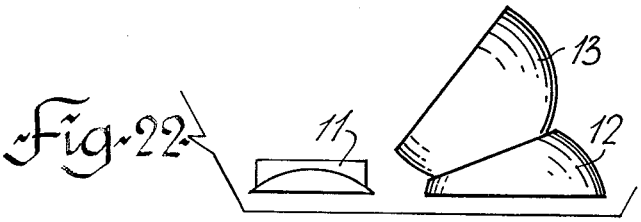
Figure 16:
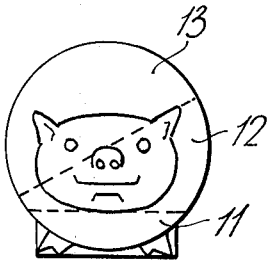
Figure 15:
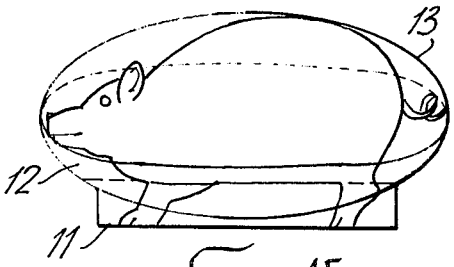

FIG. 11 being an elevational view of a football shaped shell;

FIG. 12 is an end elevational view of FIG. 11;

FIG. 13 is a front elevational view of pieces of furniture made from the shell shown in FIGS. 11 and 12;

FIG. 14 is an end elevational view of FIG. 13 but showing the furniture being used as a sofa;

FIG. 15 is a front elevational view of a shell in the shape ot a pig;

FIG. 16 is an end elevational view of FIG. 15;

FIG. 17 is a front elevational view of similar shapes progressively of smaller size with each being differently ornamented on the outer surface;

FIG. 18 illustrates one of the shells shown in FIG. 17 and pieces of furniture assembled from segments of the shell;

FIG. 19 is a front elevational view of a shell simulating four adjacent balls;

FIG. 20 is an end elevational view of FIG. 19;

FIG. 21 is a front elevational view of a sofa formed from the segments of the shell shown in FIGS. 19 and 20;

FIG. 22 is an end elevational view of FIG. 21; and

Figure 23:
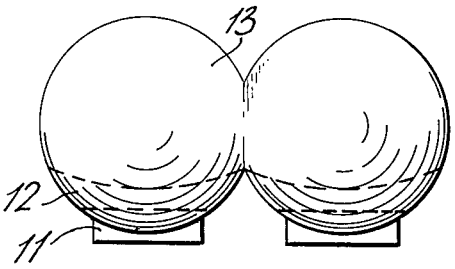

FIG. 23 is a front elevational view of a shell simulating two adjacent and interconnected balls for forming a two seat sofa.

Figure 1:
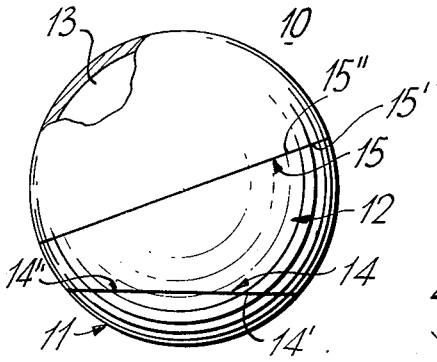
FIG. 1 is an elevational view of a closed hollow shell severed into three segments.

Referring now in detail to the drawings, shown in FIG. 1 is a rigid shell of spherical shape and made of a plastics material; the shell being divided into three segments designated respectively 11, 12 and 13. Segment 11 is formed by severing the spherical shell along a plane designated 14 and segments 12 and 13 are formed by severing the shell along a plane designated 15. The plane 14 represents a minor chord of the spherical shell and for convenience of description provides an endless peripheral edge 14' on the segment 11 and an endless peripheral edge 14'' on the segment 12. The plane 15 is along the diameter of the shell and provides a second continuous edge 15' on the segment 12 and a continuous peripheral edge 15'' on the segment 13. The sphere may be made in any size desired dependent upon the end use of the furniture to be assembled therefrom. Spheres of relatively large diameter for example 6 feet may be used to assemble furniture for adults while spheres of smaller diameter may be used for providing furniture for children. Still smaller diameters of spheres may be used for providing toy furniture for example furniture for children's dolls such as the well known Barbie doll. The wall thickness of the sphere may vary depending upon the type of material used and in the case of a plastics material or rigid foam plastics material may be approximately 2 inch thick in a sphere having 6 foot diameter.

Figure 2:
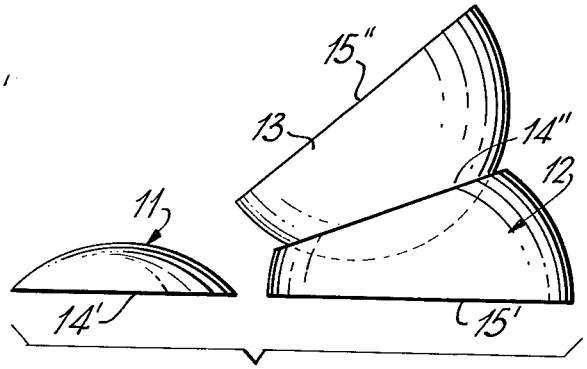
FIG. 2 is a side elevational view of a chair and footstool provided by the segments of the shell in FIG. 1.

In FIG. 2 there is illustrated pieces of furniture assembled from the segments of the sphere illustrated in FIG. 1 , segment 12 providing the base of a chair, segment 13 resting thereon and providing a seat portion of the chair and segment 11 a foot-stool. Segment 12 has the peripheral edge 15′ sitting flat on a supporting surface and the peripheral edge 14″ lies in a plane inclined at an angle thereto. The outer curvilinear surface of the sphere segment 13 rests freely on the peripheral edge 14″ of the segment 12 and thus may be readily rotated and/or tilted to various positions. The inner surface of segment 13 provides the seat portion of the chair and segment 11, inverted as shown in FIG. 2, provides a foot-stool. As will be seen hereinafter in further embodiments, segment 11 may be provided with an upper flat surface formed integrally therewith or separately attached thereto and thereby provide a table with an upper flat surface.

Figure 3:
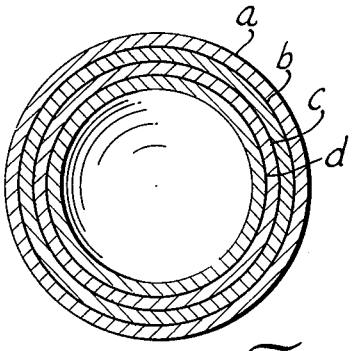
FIG. 3 is a cross-sectional view of four shells as shown in FIG. 1 and of succeedingly smaller diameters and inter-nested for storage.

As previously mentioned the spherical shell of FIG. 1 may be of various diameters and in FIG. 3 there is illustrated, in cross-section, 4 spheres designated respectively, *a*, *b*, *c* and *d* progressively smaller in diameter and inter-nested one within the other for storage purposes. Each of the shells *a*, *b*, *c* and *d* are severed along planes 14 and 15 providing three segments 11, 12 and 13 as shown in FIG. 1, the different diameter spheres providing furniture as shown in FIG. 2 of different sizes. For storage purposes it will be readily apparent from FIG. 3 relatively small area is occupied for storage of four different sets of furniture with each set being as per shown in FIG. 2.

Figure 4:
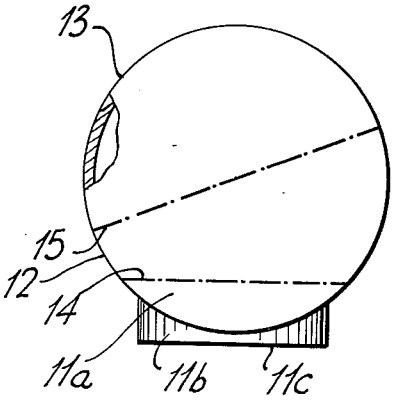
FIG. 4 is a side elevational view similar to FIG. 1 showing a modification to the shape of the lower portion of the shell.
Figure 6:
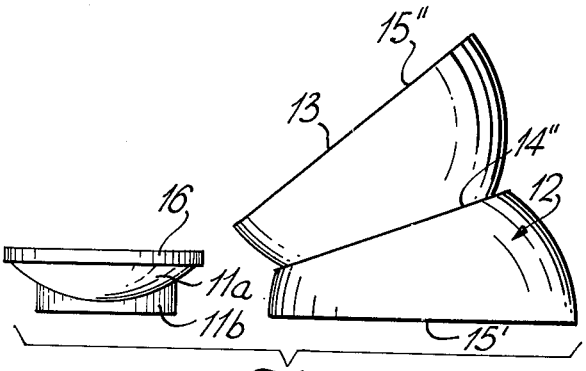
FIG. 6 is a side elevational view of pieces of furniture assembled from the segments of the shell shown in FIG. 4.

In FIG. 4 there is illustrated a modification to the shape of the shell and which provides a segment 11*a* having a cylindrical protrusion 11*b* and which terminates in a flat planar surface 11*c*. In FIG. 6 the segment 11*a* is shown in an upright position, pedestal 11*b* providing a base for a foot stool or coffee table. In FIG. 6 segment 11*a* has a planar disc shaped table top 16 resting thereon. Alternatively and if desired the disc shaped top 16 may be dispensed with and the segment 11*a* inverted from the position shown in FIG. 6 and in which case the planar end 11c would provide a flat top surface.

Figure 5:
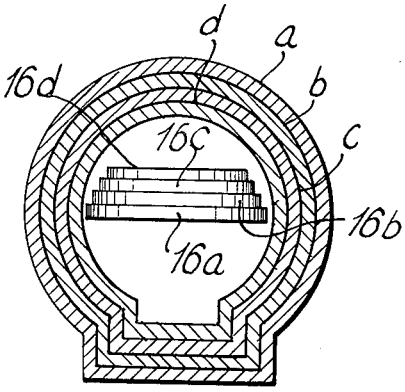
FIG. 5 is a cross-sectional view similar to FIG. 3 but of the type of shell shown in FIG. 4 inter-nested one within the other.

In FIG. 5 there is illustrated four shells *a*′, *b*′, *c*′ and *d*′ each being of the shape shown in FIG. 4 but progressively smaller in diameter and inter-nested one within the other for storage. Four disc shaped elements 16*a*, 16*b*, 16*c* and 16*d* are stored within the inntermost shell *d*′ and provide table tops for segments 11a of the various sizes provided by the shells *a*′, *b*′, *c*′ and *d*′. These shells and the shells shown in FIG. 4 are severed along planes 14 and 15 providing further segments 12 and 13 as previously described with respect to FIG. 1.

Figure 7:
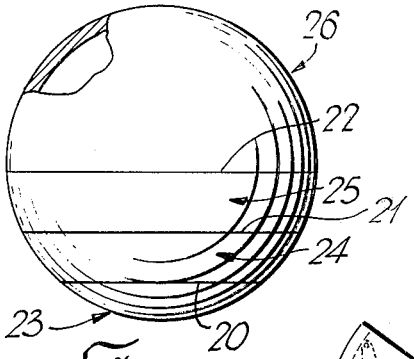
FIG. 7 is an elevational view similar to FIG. 1 but having the segments of the shell formed by cuts through the shell which are parallel to one another.
Figure 9:
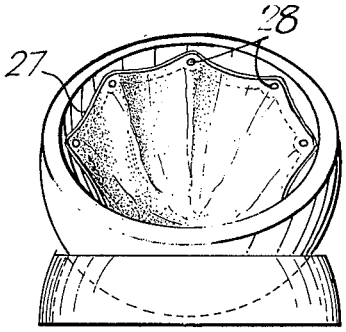
FIG. 9 is a front elevational view of the chair shown in FIG. 8.
Figure 8:
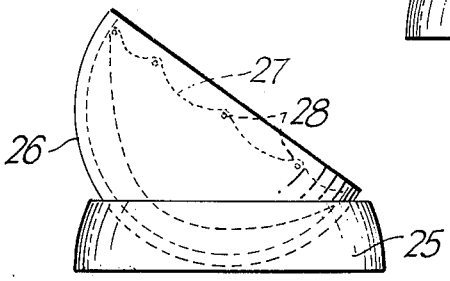
FIG. 8 is a side elevational view of a chair formed from two of the segments of the shell shown in FIG. 7.
Figure 10:
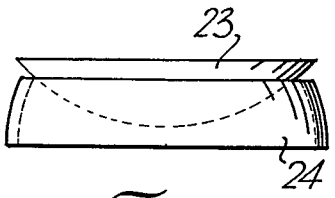
FIG. 10 is a side elevational view of a piece of furniture assembled from two of the further segments of the shell shown in FIG. 7.

In FIG. 7 there is illustrated a spherical shell but instead of being severed into segments by planes for example 14 and 15 shown in FIG. 1 and which are inclined relative to one another, and segements are provided by severing the shell along planes 20, 21 and 22 and which are parallel to one aother. Severing along the planes indicated provides shell segments 23, 24, 25 and 26 and which in FIGS. 8, 9 and 10 are shown assembled into pieces of furniture. In FIG. 8 segment 25 provides the base of a chair on which segment 26 is seated and provides the seat portion of the chair. In this embodiment, and which if desired is applicable to the previous embodiments, there is provided a flexible material 27 secured at various points around the inner surface of segment 26 and which provides a hammock type seat within the inner portion of the segment 26. In FIG. 9 the flexible material 27 is shown attached to the inner surface of segment 26 at a series of points designated 28. The means of attachment is immaterial and may consist of hooks or pins or adhesive or various combinations thereof. At least some of the points of attachment however should be detachable in the event the series of different sized pieces of furniture are provided and which are to be stored one within the other as previously described with reference to FIGS. 3 and 5.

As previously indicated the shell may be of various shapes some of which are illustrated by way of example in FIGS. 11 to 23 inclusive. The Figures are believed to be self descriptive taken particularly in conjunction with the foregoing detailed description and for convenience of discussion the segments of the different shapes are similarly designated by reference numerals 11, 12 and 13. FIGS. 11 to 14 illustrate a shell generally in the shape of a watermelon or football, FIGS. 11 and 12 showing the segments assembled for storage. In FIG. 13 there is illustrated, in front elevational view, a couch wherein segment 13 is provided with a mattress, cushions or the like designated by the reference numeral 30. In FIG. 13 a table is provided by segment 11 and on which there is mounted an oval shaped table top 16′. FIG. 14 is effectively an end elevational view of FIG. 13 depicting the article of furniture being used as a sofa wherein cushions or the like, designated generally by the reference numeral 30, provide a seat and back for occupants of the sofa. Segment 11 in FIG. 14 is inverted from the position shown in FIG. 13 and has an upper flat planar surface providing a foot rest for the occupants of the sofa. It will be understood, in each of the various shapes shown in FIGS. 11 to 23, shells of various sizes may be provided and inter-nested one within the other as previously described with reference to FIGS. 3 and 5. FIGS. 15 and 16 illustrate a shell generally in the shape of a pig while FIG. 17 shows shells generally of the shape shown in FIG. 4 but with surface ornamentation applied thereto simulating a family for example Fat Daddy, Fat Mommy, Fat Brother and Fat Sister. FIG. 18 illustrates only one of the shells shown in FIG. 17 with the lines of severance for the shell being shown in dotted lines to provide segments 11, 12 and 13 and such shells assembled to provide pieces of furniture consisting of a chair and foot rest. FIGS. 19 to 22 illustrate a shell simulating four adjacent and interconnected balls and which provides a sofa, FIG. 21 being a front view of such sofa and FIG. 22 an end view of the sofa with segment 11 providing a foot stool. FIGS. 23 is a front elevational view of a shell simulating two adjacent balls and which would provide a two seater livingroom chair with a foot stool or coffee table, the latter being provided by segment 11. Segment 12 provides the base for the sofa and segment 13 the seat and back portion of the sofa.

From the foregoing it will be obvious shells of various shapes and sizes may be utilized and when severed along appropriate planes provide components which may be assembled into furniture. The shells may be of any desired size and shape providing anything as desired from toy furniture to furniture of suitable size for actual use by adults.

I claim:

1. A piece of furniture formed from a closed hollow shell of bulbous form having a curvilinear outer surface comprising a. a base consisting of a minor segment of the hollow shell having a lower planar edge for resting flatwise on a supporting surface, and an upper continuous peripheral edge spaced from said supporting surface; and b. a main body consisting of a major segment of said hollow shell having the curvilinear outer surface thereof seated freely on and in substantially continuous contact with the upper peripheral edge of said base.

2. A piece of furniture as defined in claim 1 wherein the upper peripheral edge of said base lies in a plane parallel to said lower planar edge.

3. A piece of furniture as defined in claim 1 wherein the upper peripheral edge of said base lies in a plane inclined relative to said lower planar edge.

4. A piece of furniture as defined in claim 1, wherein said shell is substantially spherical and wherein the major segment is formed by severing the sphere in a plane along the diameter of the sphere.

5. A piece of furniture as defined in claim 1 wherein said major segment provides a chair and wherein a further segment of shell severed from the minor segment provides, when inverted, a footstool.

* * * * *